US009622561B2

(12) United States Patent
Cohen

(10) Patent No.: US 9,622,561 B2
(45) Date of Patent: Apr. 18, 2017

(54) HAIR STYLING ATTACHMENT

(75) Inventor: Gidon Cohen, Tel Aviv (IL)

(73) Assignee: Gidon Cosmetics Ltd., Tel Aviv (IL)

( * ) Notice: Subject to any disclaimer, the term of this patent is extended or adjusted under 35 U.S.C. 154(b) by 1101 days.

(21) Appl. No.: 13/505,580

(22) PCT Filed: Oct. 28, 2010

(86) PCT No.: PCT/IL2010/000889

§ 371 (c)(1),
(2), (4) Date: May 30, 2012

(87) PCT Pub. No.: WO2011/055360

PCT Pub. Date: May 12, 2011

(65) Prior Publication Data

US 2012/0234343 A1 Sep. 20, 2012

(30) Foreign Application Priority Data

Nov. 4, 2009 (IL) ..... 201914
Feb. 3, 2010 (IL) ..... 203693

(51) Int. Cl.
*A45D 40/26* (2006.01)
*A45D 20/12* (2006.01)

(52) U.S. Cl.
CPC ..... *A45D 20/12* (2013.01)

(58) Field of Classification Search
CPC ..... A45D 20/04; A45D 20/08; A45D 20/28; A45D 20/34; A45D 20/46; A45D 20/50; A45D 30/10; A45D 30/12; A45D 30/122; A45D 24/32
USPC ..... 132/212, 271, 223, 226, 229, 237, 261, 132/262, 272, 269; 219/222–224; 392/383–385; 119/613–615
See application file for complete search history.

(56) References Cited

U.S. PATENT DOCUMENTS 4,368,376 A * 1/1983 Andis ..... A45D 1/04 132/118
4,409,998 A 10/1983 Bauer
4,479,311 A * 10/1984 Blanco ..... A47L 5/24 34/90
4,629,863 A * 12/1986 Giordano ..... A45D 20/122 132/212
5,433,017 A * 7/1995 Brauchli ..... F04D 29/703 34/390
5,729,907 A * 3/1998 Santhouse ..... A45D 2/001 34/98
6,009,883 A 1/2000 Morrow
6,922,909 B2 * 8/2005 Andrew ..... A45D 20/122 132/271

(Continued)

OTHER PUBLICATIONS

International Search Report PCT Form PCT/ISA/210.

*Primary Examiner* — Todd E Manahan
*Assistant Examiner* — Brianne Kalach
(74) *Attorney, Agent, or Firm* — Muncy, Geissler, Olds & Lowe, P.C.

(57) ABSTRACT

A hair dryer/blower for use in straightening or styling hair with a round hair brush, comprising a hot air outlet, an attachment to the hot air outlet comprising a heat conducting device terminating in a flat elongated nozzle, an air inlet, and an attachment to the air inlet having a terminal shape conforming to the curvature of a round hair brush used in shaping the hair.

10 Claims, 4 Drawing Sheets

(56) References Cited

U.S. PATENT DOCUMENTS

| | | | | |
|---|---|---|---|---|
| 6,959,501 | B1 * | 11/2005 | Melzer | A45D 20/00 34/92 |
| 2005/0229423 | A1 * | 10/2005 | Keong | A45D 20/12 34/96 |

* cited by examiner

HAIR STYLING ATTACHMENT

FIELD OF THE INVENTION

The present invention relates to hair styling products for use with hair dryers and the like. More particularly, the present invention relates to attachments for a hair dryer including an attachment to the air outlet for drying hair and an attachment to the air intake to cool heated hair. The invention also relates to a hair dryer/blower with such attachments mounted thereon or integrated therewith.

BACKGROUND OF THE INVENTION

Hair generally is formed with a cuticle (the outer layer), a cortex (an inner layer), and a medulla (the innermost layer). The spiraling nature of naturally curly hair, particularly black hair, is caused by the shaft of the hair having a flat cross-section. Additionally, the cuticle of the hair serves to maintain the curly nature of the hair through a thick and durable covering of keratin proteins.

It has often been a desire of people having curly hair to straighten their hair, such as by combing and/or brushing the hair. A number of combs have been designed specifically for use with curly hair, such as the Afro pick, and a comb having holes along the spine of the comb to allow the hair a space to turn and unwind. Despite these straightening actions, however, the hair is only pulled straight for an instant, and due to the curly nature of the hair, the hair returns to its original curvature.

In order to keep the hair in a straightened state, a chemical relaxer is often applied to the hair. Chemical relaxers typically consist of a strong alkaline chemical, such as lye, and require that hair care technicians exhibit a great deal of caution in order to avoid damaging the hair, or burning the scalp of the person being treated. Moreover, due to the harshness of the chemical relaxers, it is important that the chemicals are only left on the hair for a limited period of time. In fact, chemicals left on the hair too long may even result in the hair breaking.

As an alternative to the chemical straighteners, the hair may be straightened by pressing and curling the hair. Pressing includes the application of extreme heat to the hair in order to "press out" the curls. One device used in the pressing process is a pressing comb, also known as the straightening comb. The pressing comb is made of a heavy metal and formed with a single row of teeth. The heavy metal material allows for the comb to be heated, such as by placing the comb in a heating device, and then retains the heat during the combing process. In this manner, the hair is heated and combed straight at the same time, resulting in the hair remaining in its straightened state. However, with moisture, the hair will revert back to its natural, curly state, necessitating the hair being straightened again. Consequently, it is possible that a person having curly hair could need to straighten their hair several times a week.

Another method used for straightening hair, for example, is where the user may employ a hair brush to place tension on his or her hair while applying heated air with a hair dryer. In particular, the user gathers a portion of hair and extends it away from his or her head. The extended hair portion is then treated with heated air to enable it to retain its extended shape. However, the heated air is often insufficient to adequately dry the hair to maintain it in a straightened condition.

In another similar method, a blow dryer nozzle having two rows of teeth is used. The teeth are separated to allow the air from the blow dryer to flow between the teeth to heat the hair during the combing process. While this nozzle provides localized heating for the rapid evaporation of any moisture within the hair, it is considerably cooler than the straightening comb, and therefore does not provide the same straightening effect.

U.S. Pat. No. 5,729,907 describes an attachment for a hair dryer containing on its upper section a curved heat transmitting plate with a comb extending from one side. The heat transmitting plate has a significant surface area and thus requires spaced ridges to prevent contact of scalp and fingers with the heat transmitting plate.

U.S. Pat. No. 6,009,883 discloses an improved blow dryer nozzle having two parallel rows of teeth disposed on opposite sides of the nozzle with a steel heating bar situated between the two rows of teeth. The steel heating bar extends slightly higher than the base of the teeth for striking the hair within the teeth. As the hair passes over the heating bar, the heated bar straightens the hair, much like the effects of using a traditional straightening comb.

Thus, the main concern of improvements to hair dryers was to enable the blower to supply sufficient hot air to dry the hair quickly. However, it is often desired to cool the hair right after having shaped it with the heated air from the blower nozzle. A common method of cooling the hair while being shaped with a round brush is to reverse the hair dryer and place the air intake against the hair on the brush. This sucks room temperature air through the hair to cool them. This method, although widespread, is not very efficient in that the suction is quite weak and takes long to dry the hair.

SUMMARY OF THE INVENTION

Against the foregoing background, it is a primary object of the present invention to provide a hair dryer/blower, in particular for use by professional hair dressers, with an attachment to straighten the hair quickly with the aid of a hair brush and/or an attachment to cool the hair efficiently while straightening or styling the hair with the aid of a hair brush.

Another object of the present invention is to provide an attachment for a professional hair dryer/blower that helps straighten the hair by optionally drawing the hair with a hair brush across a heat conducting surface of the attachment.

A still further object of the present invention to provide an attachment for a professional hair dryer/blower that provides high volume concentrated ambient air flow to the dryer/blower.

Still another object of the invention is to provide an attachment for a hair dryer/blower that will aid in cooling the hair more efficiently.

Yet another object of the invention is to provide a method of styling or straightening hair with a brush and hair dryer/blower, by alternating heating and cooling the hair.

In accordance with one embodiment of this invention there is provided a nozzle attachment for a hair dryer/blower for straightening hair with the aid of a hair brush, comprising:

a hollow body, comprising:

a base section sized for attachment to a blow-dryer, a fishtail section extending from the base section terminating in a nozzle with an elongated opening, the fishtail section comprising two parallel flat walls and side walls with at least one flat wall having a cut out section in its center, a heat conducting plate mounted over the outer surface of the at least one flat wall with the cut out section up to the opening of the nozzle, whereby, when the nozzle attachment is connected to the air outlet of a hair dryer/blower and the dryer is turned on to blow hot air through the outlet, the hot air passes over the heat conducting plate(s) raising the temperature of the plate(s), so that when the edge of the nozzle attachment with the heat conducting side is drawn over wet hair as it is shaped with a hair brush, the hair is fixed in the shaped condition due to the drying at a higher temperature.

This nozzle attachment thus provides a simple means for using a hair dryer/blower to dry and straighten one's hair. When only one flat wall of the attachment is covered with a heat conducting plate the nozzle attachment can be used in two ways either by contacting the hair with the side containing the heat conducting plate or with the side without a heat conducting plate.

In another embodiment, the heat conducting plate overlaps and curves inward into the nozzle on the side of the plate. This prevents any possible scratching of scalp or fingers by the edge of the heat conducting plate.

In yet another embodiment, there are provided heat conducting plates on both flat walls of the nozzle attachment to maximize the hot air dispensed by the hair dryer/blower.

In a most preferred embodiment, the nozzle attachment has means, such as fins, that space the heat conducting plate away from contact with the scalp of the person using the dryer/blower.

The heat conducting plate can be of any metal or other like material, such as of ceramic, with a steel plate being preferred in that it does not corrode.

It is also contemplated within the present invention that a nozzle attachment as defined above be integrally molded as part of the dryer/blower housing.

The method of using the dryer/blower with the nozzle attachment is quite simple. A hair dresser, or for that matter anyone desiring to shape/straighten thick/curly hair attaches the inventive nozzle attachment to a hair blow dryer and works up the hair with a hair brush in a conventional manner. However, he/she contacts the hair that is being shaped with the brush, with the air passing over the heat conducting plate of the nozzle attachment which has been heated to a high temperature, to fix the shape of the hair.

In accordance with the present invention there is also provided an air intake attachment for a hair dryer/blower for use in straightening or styling hair with a round hair brush, said hair dryer/blower comprising a nozzle for blowing hot air and an air intake that sucks in air at room temperature, characterized in that the air intake attachment comprises, a ring shaped base section seized for attachment to the air intake of a dryer/blower, means for mounting the attachment to the dryer/blower, a cylindrical wall extending from the base section, said wall terminating in a curvature contoured to engage a round hair brush, whereby the ambient air is sucked through the hair and brush at high volume and maximum force to cool the hair.

In a preferred embodiment the cylindrical wall extending from the base section flares out to provide a larger air intake area.

It is preferred that the air intake attachment have filter means to prevent undesirable objects from entering the dryer/blower mechanism.

The air intake of the dryer/blower can have the cylindrical extension integrally molded therewith terminating with a curvature conforming to a round hair brush, or it can have as a separate attachment with a cylindrical wall terminating with a proper curvature that can be mounted on a conventional air intake of a dryer/blower.

The air intake attachment thus provides a simple and efficient means for using the dryer/blower to cool hair quickly right after being heated and straightened or shaped by the hair blower. Thus the invention provides a hair dryer/blower with dual capabilities, to heat the hair and subsequently cool it efficiently. A hair dresser can thus use the same dryer/blower by first blowing hot air unto the hair while brushing it to straighten it out and then turn the dryer/blower around quickly to cool the hair as necessary and repeat this procedure as needed.

BRIEF DESCRIPTION OF THE DRAWINGS

The foregoing and still further objects and advantages of the present invention will be more apparent from the following detailed explanation of the preferred embodiments of the invention in connection with the accompanying drawings.

DETAILED DESCRIPTION OF THE PREFERRED EMBODIMENTS

Figure 1:
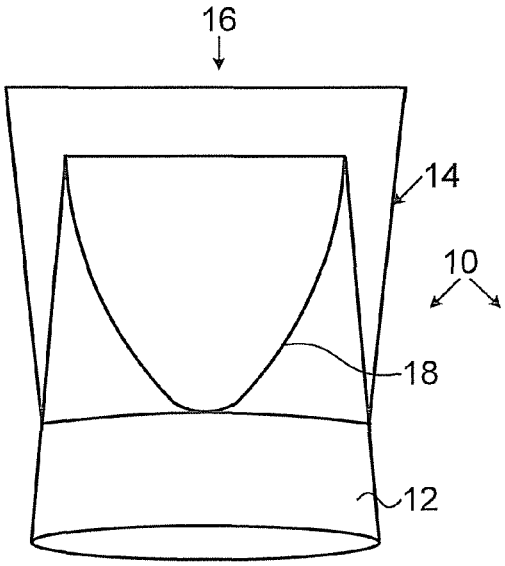
FIG. 1 is a view of one side of a nozzle attachment device in accordance with an embodiment of the present invention.
Figure 2:
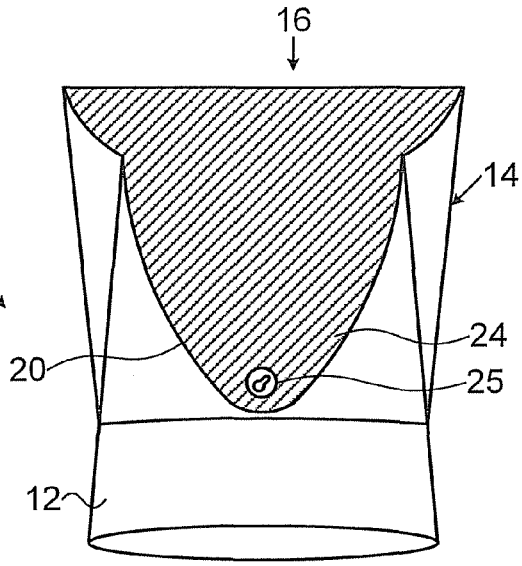
FIG. 2 is a view of the other side of the attachment device of FIG. 1
Figure 3:
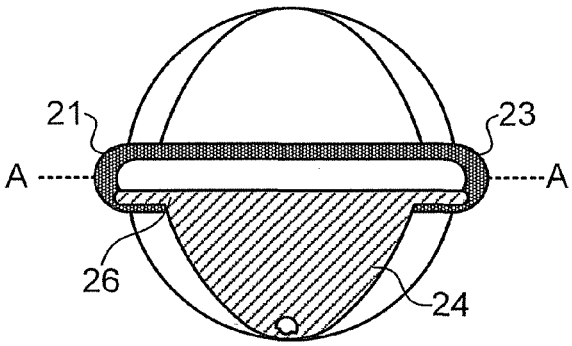
FIG. 3 is a top view of the attachment device of FIG. 1
Figure 4:
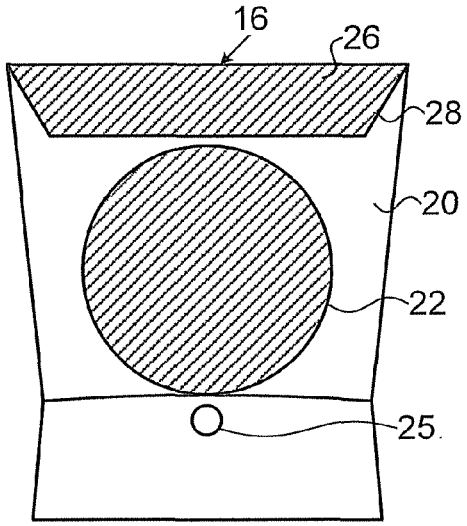
FIG. 4 is a cross sectional view across A-A of FIG. 3 showing the inside wall 22 of FIG. 2.

Referring to FIGS. 1 to 4, there is illustrated a preferred embodiment of a hair dryer nozzle attachment 10. The attachment 10 is generally made of an appropriate polymeric material. The attachment comprises a hollow base section 12 sized for attachment to the air exit of a blow-dryer (see FIG. 13). A fishtail section 14 extends from the base section 12 and is comprised of two opposite substantially flat walls 18 and 20. Walls 18 and 20 together with edges 21 and 23 respectively, terminate in an elongated nozzle 16. Wall 20 has a relatively large cut out section 22 (FIG. 4), the purpose of which will be discussed later on. A heat conducting plate 24 is mounted on the outside of wall 20 covering the cut out section 22 and the outside of nozzle 16. The plate 24 is fastened to the wall 20 with a pin 25. In a preferred embodiment the heat conducting plate 24 is bent 26 over the edge of the nozzle wall 28 on the side of wall 20. The preferred embodiment has the advantage that the heat conducting plate does not end at the tip of the nozzle with a sharp edge that may cut or injure a person's hair or scalp.

Figure 5A:
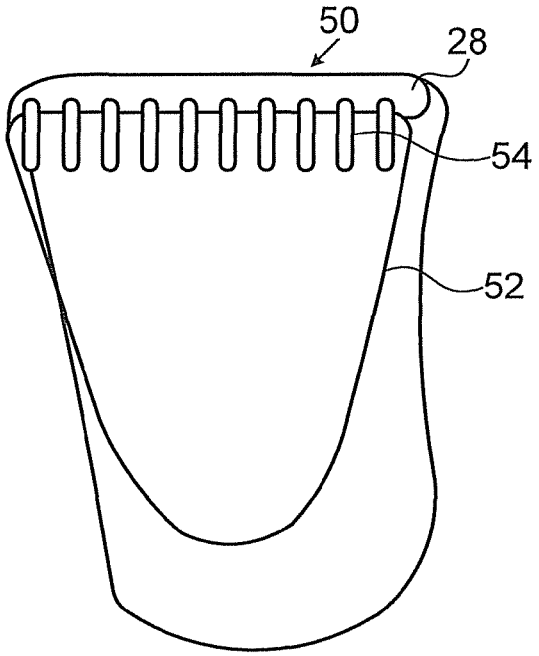
FIG. 5A is a perspective view of another embodiment of a nozzle attachment device in accordance with the present invention.
Figure 5B:
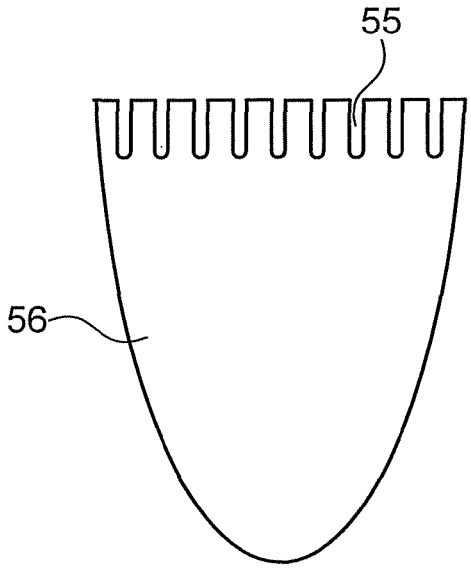
FIG. 5B is a front view of the heat conducting plate of the nozzle attachment device illustrated in FIG. 5.

Referring to FIG. 5A which is a perspective view of a nozzle attachment device 50, in accordance with another embodiment of the present invention. Nozzle attachment 50 differs from attachment 10 shown in FIGS. 1-4, in that fishtail section 52 includes a plurality of protruding fins 54 along the edge of the wall 52 near nozzle 28. These fins 54 traverse slits 55 in the heat conducting plate 56 (seen in FIG. 5B). The protruding fins 54 are integral parts of the device 50 and are preferably from the same non-conducting polymeric material. These protruding fins 54 act as safety barriers, that prevent direct contact between the scalp and conducting plate 56, thus protecting the scalp from getting overheated and even burned.

The number and the shape of protruding fins 54 may of course vary, as long as there is a separation between the conducting plate and the edge of the nozzle.

According to yet another embodiment of the nozzle attachment of the present invention, there can be a single protruding piece (not shown) along the edge of the nozzle wall 28 instead of protruding fins 54. In this case, the scalp is even better protected from contacting conducting plate 56.

Figure 6:
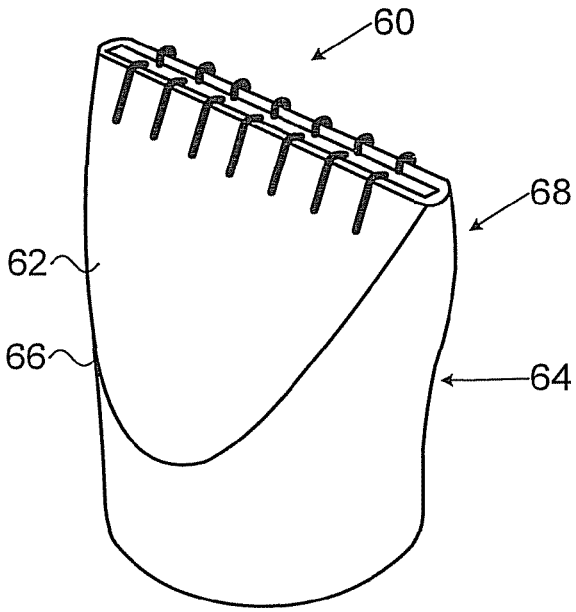
FIG. 6 illustrates a nozzle attachment in accordance with the present invention wherein heat conducting plates are mounted on two sides of the attachment.
Figure 7:
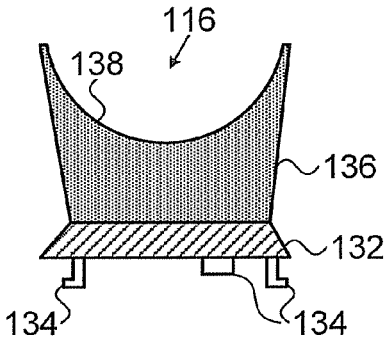
FIGS. 7 and 7A are plan views of an air intake attachment device in accordance with this invention.
Figure 7A:
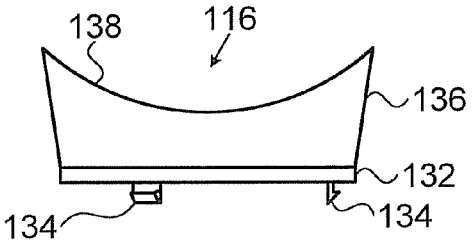
Figure 8:
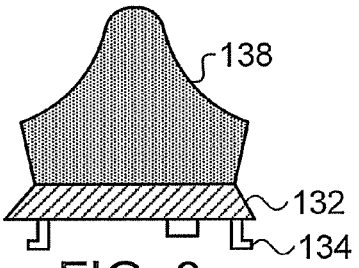
FIG. 8 is a plan view of the air intake attachment shown in FIG. 7 turned 90 degrees.
Figure 9:
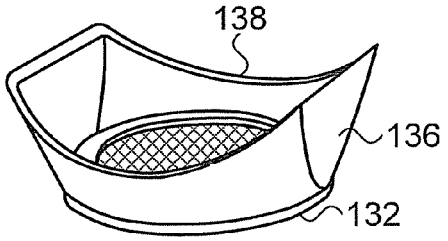
FIG. 9 is a perspective view of an air intake attachment in accordance with this invention.
Figure 10:
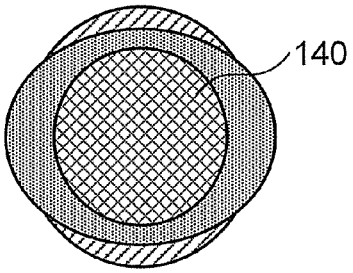
FIGS. 10 and 10A are views of the air intake attachment as seen from above.
Figure 10A:
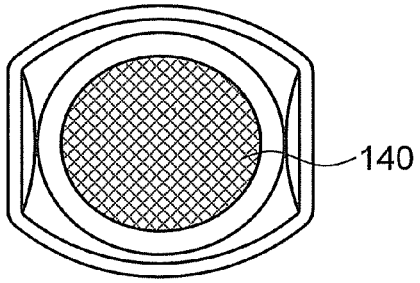
Figure 11:
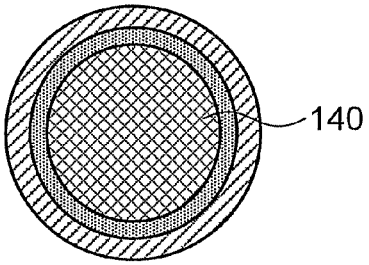
FIG. 11 is a view of the air intake attachment seen from below.

FIG. 6 shows a nozzle attachment 60 having heat conducting plates 62, 64 (not visible) mounted on both flat walls 66, 68 of the attachment 60.

Figure 12:
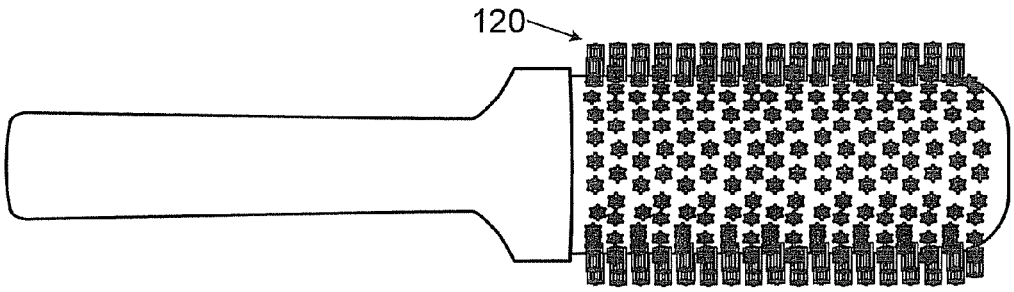
FIG. 12 shows a round hair brush for use with a dryer/blower in accordance with the present invention.
Figure 13:
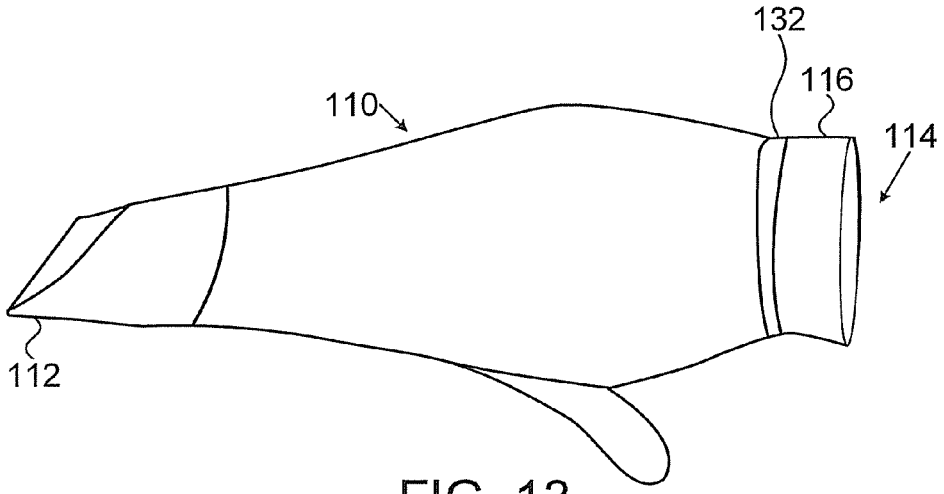
FIG. 13 is a plan view of a hair dryer/blower with attachments in accordance with this invention.
Figure 14:
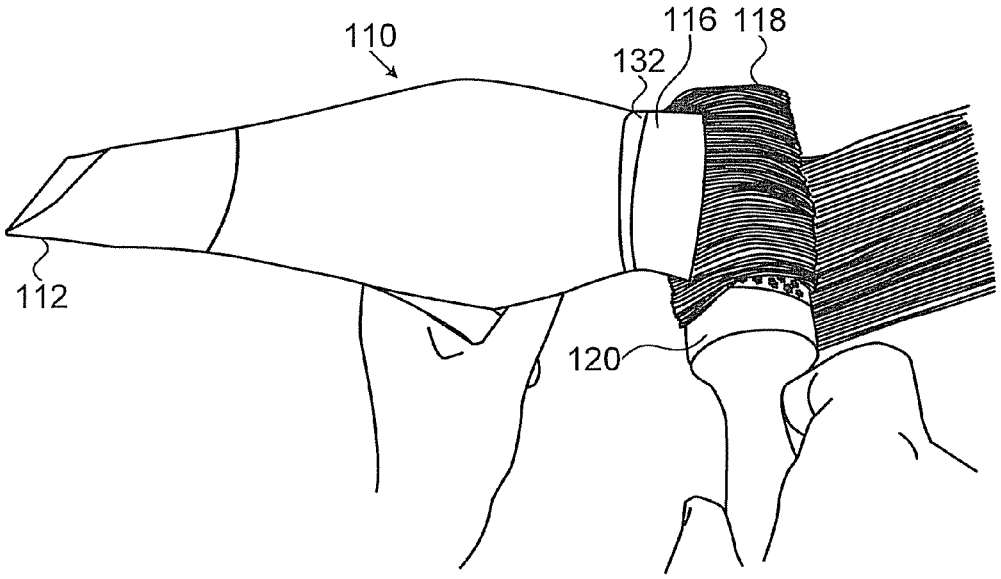
FIG. 14 is a plan view of a hair dryer/blower in accordance with this invention as it is used with a hair brush.

Referring now to FIGS. 7 to 11 there is shown an air intake attachment 116 for mounting onto the air intake of a hair dryer/blower (see FIG. 13). The attachment 116 is generally made of an appropriate polymeric material and comprises a ring shaped base section 132 sized for attachment to the air intake 114 of a blow-dryer 110. The base section 132 has means 134 for mounting the attachment to the air intake of the dryer/blower. A cylindrical wall 136 extends from the base section 132 and terminates in a curvature 138 contoured to engage a round hair brush 120 as shown in FIGS. 12 and 14. The ring shaped base section 132 preferably has a wire mesh filter 140 to prevent foreign objects to be sucked into the dryer/blower 110.

Referring to FIGS. 13 and 14, there is illustrated a hair dryer/blower 100 with a nozzle attachment device 112 at one end through which heated air is blown and at other end of the dryer/blower 100 is an air intake attachment 116 through which atmospheric air 114 is drawn. FIG. 14 illustrates the dryer/blower 110 with the air intake attachment 116 in operation. The attachment 116 is placed directly against the hair 118 on the brush 120, and as cool air is sucked into the dryer/blower 110 and cools the hair 118 prior to entering the dryer/blower 110 where it may be heated. The cool air passes through the brush 120 and hair 118.

The attachments of this invention are used as follows. A person, usually a hair-dresser, uses the blow dryer with attachments together with a hair brush. The hair dresser/person gathers a portion of wetted hair with a hair brush and extends it away from the person's head. While brushing the wet thick and/or curly hair with one hand the hair-dresser/person contacts the hair with the heat conducting plate of the nozzle attachment with the other hand. The hot air coming from the blow dryer heats the conducting plate which retains and increases the heat thus drying and fixing the shape of the hair more permanently. When the heat conducting plate is only on one outside wall of the attachment the hair blow dryer can be used either with the wall having the heat conducting plate facing the scalp or in an inverted position with the other polymeric material wall facing the scalp, thus giving the hair-dresser greater flexibility. In embodiments having nozzle attachments with fins protruding beyond the conducting plate, the fins prevent touching the skin or scalp with the heated plate. The hair dresser/person then turns the hair dryer/blower around and places the air intake with the air intake attachment against the hair on the hair brush to cool the hair. This process of heating and cooling is often repeated a number of times to permanently set the hair.

Hair dryer/blowers can be used with either the nozzle attachment or air intake attachment mounted thereon or with both of these attached.

It is contemplated within the concept of this invention that the nozzle attachment and/or air intake attachment can be formed as an integral part of the dryer/blower housing.

What is claimed is:

1. A hair dryer/blower for use in straightening or styling hair with a round hair brush, said hair dryer/blower comprising:
   - a hot air outlet through which hot air is blown having a hollow body, comprising:
     - a base section sized for attachment to the dryer/blower;
     - a fishtail section extending from the base section terminating in a nozzle with an elongated opening, the fishtail section comprising two parallel flat walls and side walls with one flat wall having a cut out section in its center, and a heat conducting plate mounted on the outer surface of the one flat wall up to the opening of the nozzle, and
     - a heat conducting plate bent over to cover the elongated edge of the nozzle extending into the opening of the nozzle;
   - an air inlet for sucking in air at room temperature;
   - an attachment to the air inlet; and
   - an attachment to the hot air outlet including a heat conducting device terminating in a flat elongated nozzle,
   - wherein when the dryer/blower is turned on to blow hot air through the outlet, the hot air passes over the heat conducting device raising the temperature so that when an edge of the nozzle is drawn over wet hair that is being shaped with the hair brush the hair is fixed in a shaped condition due to the drying at a relatively higher temperature, and wherein the attachment to the air inlet includes a terminal shape conforming to the curvature of the round hair brush used in shaping the hair thereby increasing a flow of cool air through the hair when the attachment to the air inlet is brought in direct contact with heated air on the round brush as the ambient temperature is sucked through the hair brush at high volume and increased force.

2. The hair dryer/blower of claim 1, wherein the flat wall on which the heat conducting plate is mounted includes a protruding extension along its edge at the nozzle, distancing the conducting plate from the nozzle to prevent contact of the heat conducting plate with the neck or scalp when operating the device.

3. The hair dryer/blower of claim 1, wherein the protruding extension includes fins traversing slots in the heat conducting plate.

4. The hair dryer/blower of claim 1, wherein both flat walls of the attachment to the hot air outlet include cut out sections in their centers and wherein heat conducting plates are mounted on both flat walls.

5. The hair dryer/blower of claim 1, wherein the heat conducting plate of the attachment to the hot air outlet is a steel plate.

6. The hair dryer/blower of claim 1, wherein the attachment to the air inlet comprises: a ring shaped base section sized for attachment to the air intake of a blow-dryer; a device for mounting the attachment to the air intake of the dryer/blower; and a cylindrical wall extending from the base section, said wall terminating with a curvature contoured to engage a round hair brush.

7. The hair dryer/blower of claim 6, wherein the base section of the attachment to the air inlet includes a filter.

8. The hair dryer/blower of claim 7, wherein the filter is a wire mesh filter.

9. The hair dryer/blower of claim 1, wherein the attachments are formed as an integral part of the dryer/blower.

10. The hair dryer/blower of claim 1, wherein both flat walls of the attachment to the hot air outlet include cut out sections in their centers and wherein heat conducting plates are mounted on both flat walls.

* * * * *